US006271810B1

(12) United States Patent
Yoo et al.

(10) Patent No.: US 6,271,810 B1
(45) Date of Patent: Aug. 7, 2001

(54) PLASMA DISPLAY PANEL USING RADIO FREQUENCY AND METHOD AND APPARATUS FOR DRIVING THE SAME

(75) Inventors: Yeun Ho Yoo, Kyunggi-do; Jun Yeong Yoo, Seoul; Jeong Pil Choi, Kyunggi-do, all of (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/361,571

(22) Filed: Jul. 27, 1999

(30) Foreign Application Priority Data

| | | |
|---|---|---|
| Jul. 29, 1998 | (KR) | P98-30746 |
| Aug. 21, 1998 | (KR) | P98-34024 |
| Nov. 3, 1998 | (KR) | P98-46983 |
| Jun. 12, 1999 | (KR) | P99-21882 |

(51) Int. Cl.[7] ..... G09G 3/28
(52) U.S. Cl. ..... 345/60; 315/169.4
(58) Field of Search ..... 345/60, 61, 62, 345/63, 66, 68, 74.1, 76; 315/167, 168, 169.1, 169.4; 313/484, 491, 514, 517, 520

(56) References Cited

U.S. PATENT DOCUMENTS

| | | | | |
|---|---|---|---|---|
| 5,654,727 | * | 8/1997 | Lepselter | 345/60 |
| 5,667,705 | * | 9/1997 | Miyazaki et al. | 345/60 |
| 5,990,630 | * | 11/1999 | Nakamura | 315/169.4 |

* cited by examiner

*Primary Examiner*—Regina Liang
(74) *Attorney, Agent, or Firm*—Fleshner & Kim, LLP

(57) ABSTRACT

A plasma display panel that is adaptive for utilizing a radio frequency discharge. In the panel, a data is applied to a data electrode, and a scanning electrode is arranged perpendicularly to the data electrode. The scanning electrode causes an address discharge along with the data electrode by applying a scanning pulse. A radio frequency signal is applied to a radio frequency electrode, and a radio frequency reference electrode causes a radio frequency discharge along with the radio frequency electrode by applying a reference voltage of the radio frequency signal.

25 Claims, 11 Drawing Sheets

PLASMA DISPLAY PANEL USING RADIO FREQUENCY AND METHOD AND APPARATUS FOR DRIVING THE SAME

BACKGROUND OF THE INVENTION

1. Field of the Invention

This invention relates to a plasma display device, and more particularly to a plasma display panel that is adapted to make use of a radio frequency discharge.

2. Description of the Related Art

Recently, a plasma display panel (PDP) feasible to the fabrication of large-scale panel has been available for a flat panel display device. The PDP controls a discharge interval of each pixel to display a picture. Such a PDP typically includes a PDP of alternating current (AC) system having three electrodes and driven with an AC voltage as shown in FIG. 1.

FIG. 1 shows the conventional AC system PDP having discharge cells arranged in a matrix pattern. The discharge cell includes a sustaining electrode pair 12A and 12B formed on an upper substrate 10 sequentially, an upper plate having an upper dielectric layer 14 and a protective film 16, and a lower plate having an address electrode 20, a lower dielectric layer 22, a barrier rib 24 and a fluorescent layer 26. The upper substrate 10 and the lower substrate 18 are spaced, in parallel, by the barrier rib 24. The sustaining electrode pair 12A and 12B consists of a scanning/sustaining electrode and a sustaining electrode. A scanning signal for a panel scanning and a sustaining signal for a discharge sustaining are applied to the scanning/sustaining electrode 12A while a sustaining signal is applied to the sustaining electrode 12B. An electric charge is accumulated into the upper dielectric layer 14 and the lower dielectric layer 22. The protective film 16 prevents a damage of the upper dielectric layer 14 due to the sputtering, thereby prolonging a life of PDP as well as improving an emissive efficiency of secondary electrons. Usually, MgO is used as the protective film 16. The address electrode 20 is crossed with the sustaining electrode pair 12A and 12B. A data signal is applied to the address electrode 20. The barrier rib 24 is formed in parallel to the address electrode 20. The barrier 24 prevents an ultraviolet ray produced by a discharge from being leaked into the adjacent cell. The fluorescent layer 26 is coated on the surface of the lower dielectric layer 22 and the barrier rib 24 to generate any one of a red, green, and blue visible lights. An inactive gas for a gas discharge is injected into an inner discharge space.

The PDP cell having the structure as described above sustains a discharge by a surface discharge between the sustaining electrode pair 12A and 12B after being selected by an opposite discharge between the address electrode 20 and the scanning/sustaining electrode 12A. In the discharge cell, the fluorescent body 26 is radiated by an ultraviolet ray generated during the sustaining discharge to emit a visible light into the exterior of the discharge cell.

Such a PDP controls a discharge-sustaining interval, that is, a sustaining discharge frequency of the discharge cell to implement a gray scale required for an image display. Accordingly, the sustaining discharge frequency becomes an important factor for determining the brightness and a discharge efficiency of the PDP. For the purpose of performing such a sustaining discharge, a sustaining pulse having a duty ratio of 1, a frequency of 200 to 300 kHz and a width of about 10 to 20 $\mu$s is alternately applied to the sustaining electrode pair 12A and 12B. The sustaining discharge is generated only once at an extremely short instant per the sustaining pulse by responding to the sustaining pulse. Charged particles generated by the sustaining discharge are moved along a discharge path formed between the sustaining electrode pair 12A and 12B in accordance with the polarity of the sustaining electrode pair 12A and 12B and accumulated in the upper dielectric layer to be left into a wall charge. This wall charge lowers a driving voltage during the next sustaining discharge, but reduces an electric field in the discharge space during the corresponding sustaining discharge. Accordingly, when a wall charge is formed during the sustaining discharge, a discharge is interrupted. As described above, the sustaining discharge is generated only once at an extremely shorter instant than a width of the sustaining pulse, and it is consumed for a formation step of wall charge and a preparation step of the next sustaining discharge. Due to this, in the conventional PDP, a real discharge interval becomes very short in comparison to the entire discharge interval to have a low brightness and discharge efficiency.

In order to solve such a problem of low brightness and discharge efficiency, we has suggested a method of utilizing a radio frequency discharge using a radio frequency signal of tens of to hundreds of MHz. In the case of the radio frequency discharge, electrons perform an oscillating motion by the radio frequency signal to sustain the display discharge during a time interval when the radio frequency signal is applied. More specifically, when a radio frequency voltage signal having an alternately inverted polarity is applied to any one of the two opposed electrodes, electrons within the discharge space are moved toward one electrode or the other electrode depending on the polarity of the voltage signal. In the case where electrons are moved into any one electrode, if the polarity of a radio frequency voltage signal having been applied to the electrode before the electrons arrive at the electrode is changed, then a movement speed of the electrons is decelerated gradually and hence a movement direction thereof is changed toward the other opposed electrode. The polarity of the radio frequency voltage signal is changed before the electrons within the discharge space arrive at the electrode in this manner, so that the electrons do an oscillating motion between the two electrodes. Accordingly, when the radio frequency voltage signal is being applied, ionization, an excitation and a transition of gas particles are continuously generated without an extinction of electrons. The display discharge is sustained during most discharge time to thereby improve the brightness and a discharge efficiency of the PDP. Such a radio frequency discharge has the same physical characteristic as a positive column in a glow discharge structure.

The conventional PDP having the cell structure shown in FIG. 1 is unsuitable for making use of the above-mentioned radio frequency discharge. In other words, in order to utilize the radio frequency discharge as the display discharge, a distance between the two electrodes must be assured sufficiently. However, in the AC system PDP of FIG. 1, since the scanning/sustaining electrode 12A and the sustaining electrode 12B are spaced in a very short distance on the same plane, a radio frequency discharge is not caused as long as a frequency of the radio frequency signal is very high. Accordingly, it is necessary to provide a PDP having a structure suitable for making use of the radio frequency discharge.

SUMMARY OF THE INVENTION

Accordingly, it is an object of the present invention to provide a plasma display panel that is adaptive for utilizing a radio frequency discharge.

Further object of the present invention is to provide a PDP driving method and apparatus that is adaptive for driving the PDP utilizing a radio frequency.

In order to achieve these and other objects of the invention, a radio frequency plasma display panel according to one aspect of the present invention includes a data electrode to which a data is applied; a scanning electrode for causing an address discharge along with the data electrode by applying a scanning pulse, said scanning electrode being arranged perpendicularly to the data electrode; a radio frequency electrode to which a radio frequency signal is applied; and a radio frequency reference electrode for causing a radio frequency discharge along with the radio frequency electrode by applying a reference voltage of the radio frequency signal.

A driving method for a radio frequency plasma display panel according to another aspect of the present invention includes the steps of applying a voltage to each of a data electrode and a scanning electrode included in the display panel; and applying a radio frequency signal and a reference voltage of the radio frequency signal to the radio frequency electrode and the radio frequency reference electrode included in the display panel, respectively, in such a manner that electrons within the discharge cell do an oscillating motion, thereby causing a radio frequency discharge.

A driving method for a radio frequency plasma display panel according to still another aspect of the present invention includes the steps of applying a voltage to each of a data electrode and a scanning electrode included in the display panel to produce electrons within a discharge cell; and applying phase-inverted radio frequency signals to each of the first and second radio frequency electrodes included in the display panel in such a manner that the electrons within the discharge cell do an oscillating motion, thereby causing a radio frequency discharge.

A driving apparatus for a radio frequency plasma display panel according to still another aspect of the present invention includes a display panel having a data electrode supplied with a data, a scanning electrode for causing an address discharge along with the data electrode, a radio frequency electrode applied with a radio frequency signal, and a radio frequency reference electrode for causing a radio frequency discharge along with the radio frequency electrode; an address driver for causing an address discharge by applying the data and a scanning pulse to the data electrode and the scanning electrode, respectively; and a radio frequency driver for causing a radio frequency discharge by applying a radio frequency signal and a reference voltage of the radio frequency signal to the radio frequency electrode and the radio frequency reference electrode, respectively.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
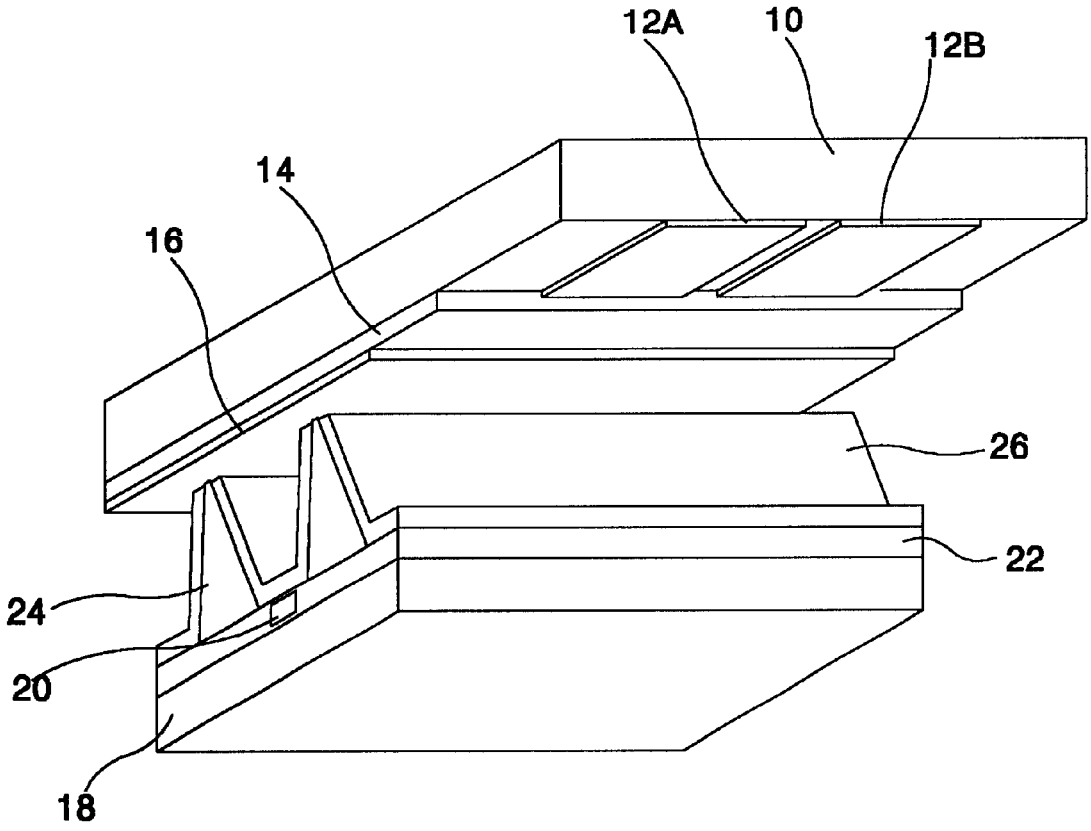
FIG. 1 RELATED ART
FIG. 1 is a perspective view showing the structure of a discharge cell of the conventional three-electrode AC-system PDP.
Figure 2:
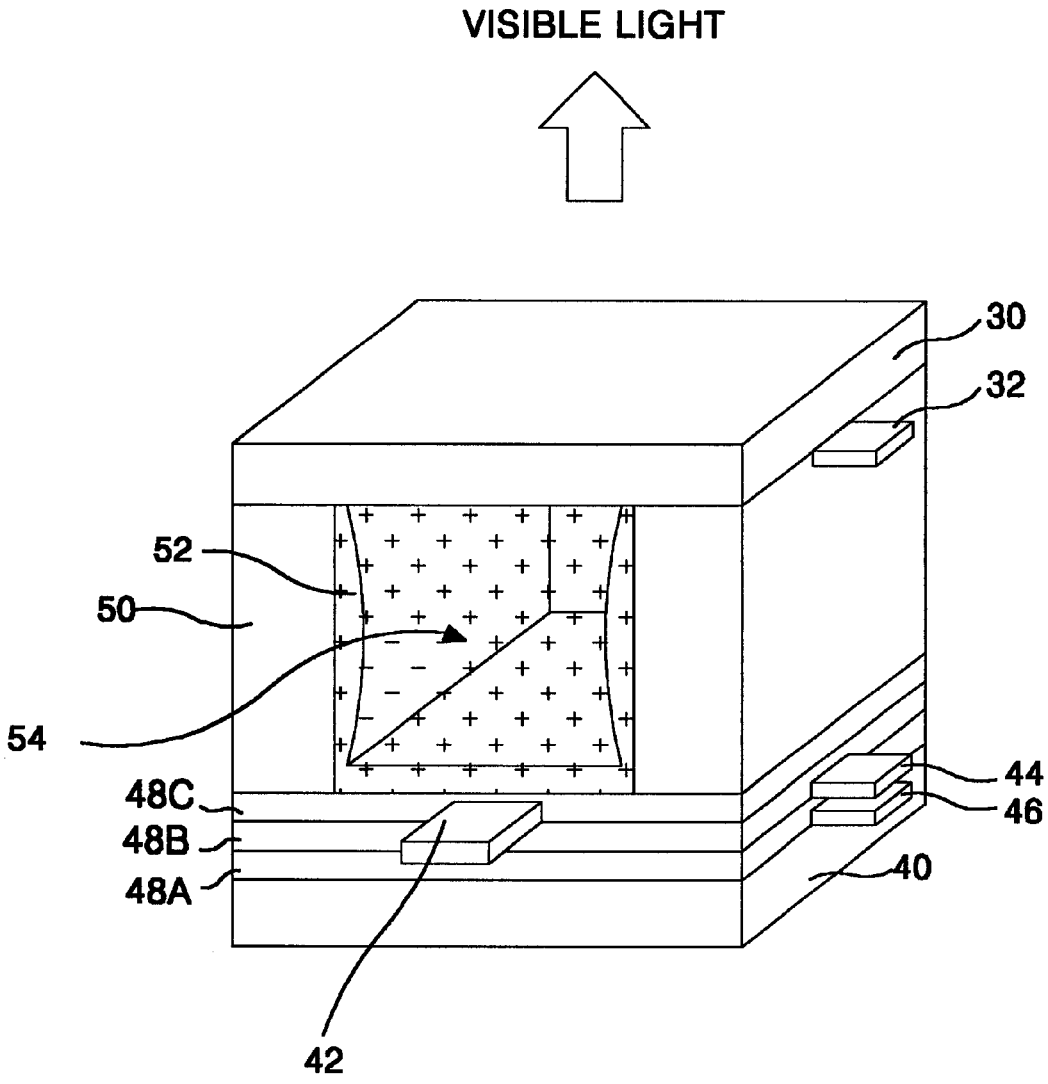
FIG. 2 is a perspective view showing the discharge cell structure of a radio frequency PDP cell according to an embodiment of the present invention.

Referring to FIG. 2, there is shown a discharge cell of a radio frequency PDP cell according to an embodiment of the present invention. The discharge cell includes an upper substrate 30 provided with a first radio frequency electrode 32, a lower substrate 40 provided with an address electrode 42, a scanning electrode 44 and a second radio frequency electrode 46, and a barrier rib 50 formed perpendicularly between the upper substrate 30 and the lower substrate 40. A discharge gases is injected into a discharge space 54 provided by the upper substrate 30, the lower substrate 40 and the barrier rib 50. It is desirable to use a Xe gas having a relatively low exciting energy level or use a mixture gas in which He and Ne, etc. Are mixed with a Xe gas so as to improve the efficiency. This is caused by a fact that a penning effect is largely used in the general alternating current (AC) PDP or direct current (DC) PDP while positive ions are almost in a stationary state and oscillating electrons largely excite a gas atom. Meanwhile, since an orange color generating at Ne is produced when an energy level of electrons at the time of radio frequency discharge concentrates on the excitation energy of Xe, the color purity is improved.

The first radio frequency electrode 32 is formed of a transparent material on the upper substrate 30 in a direction perpendicular to the address electrode 42. The second radio frequency electrode 46 is formed oppositely on the lower substrate 40 in a direction parallel to the first radio frequency electrode 32. The first and second radio frequency electrodes 32 and 46 cause a radio frequency discharge by a radio frequency signal applied in a sustaining interval. The second radio frequency electrode 46 may be applied with an additional radio frequency signal as a reference electrode of the first radio frequency electrode 32 and applied with a ground voltage GND or a specific level of direct current voltage. The first and second radio frequency electrodes 32 and 46 is formed in a shape of line electrode in FIG. 2, but may be formed in a shape of leaf electrode. A first dielectric layer 48A is fully deposited on the second radio frequency electrode 46 and the lower substrate 40. The first dielectric layer 48A plays a role to electrically insulate the second radio frequency electrode 46 and the scanning electrode 44. The scanning electrode 44 is formed on the first dielectric layer 48A in a direction parallel to the second radio frequency electrode 46. A second dielectric layer 48B is fully deposited on the scanning electrode 44 and the first dielectric layer 48A. The second dielectric layer 48B is responsible for electrically insulating the scanning electrode 44 and the address electrode 34. The address electrode 42 is formed on the second dielectric layer 48B in a direction perpendicular to the scanning electrode 44. The scanning electrode 44 and the address electrode 42 causes an address discharge by a scanning pulse applied in the addressing interval and a video data. Meanwhile, since the scanning electrode 44 and the address electrode 42 is opposed adjacently with intervening the second dielectric layer 48B, a voltage level for causing an address discharge can be lowered to that extent. Otherwise, the scanning electrode 44 and the address electrode 42 may be formed on the upper substrate 30 and the lower substrate 40, respectively, in such a manner to be opposed with intervening a discharge space 54.

The barrier rib 50 prevents an optical interference between the adjacent discharge cells and provides a movement path of electrons at the time of radio frequency discharge. A fluorescent body 52 for emitting an inherent color of visible light by a vacuum ultraviolet generated during the radio frequency discharge is coated on the surfaces of the barrier rib 50 and a third dielectric layer 48C.

Figure 3:
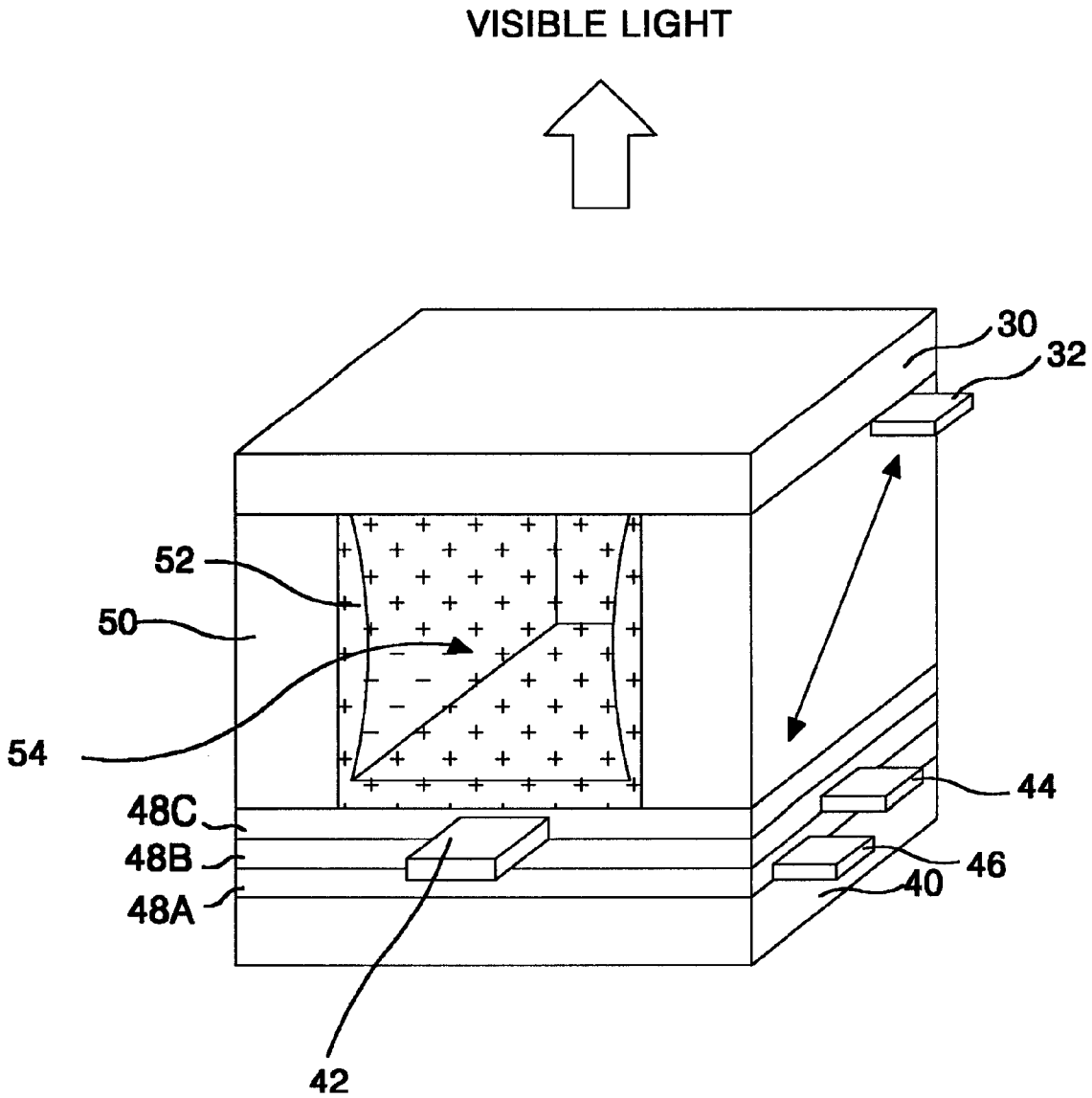
FIG. 3 is a perspective view showing the discharge cell structure of a radio frequency PDP cell according to another embodiment of the present invention.

On the other hand, the first and second radio frequency electrodes 32 and 46 are installed oppositely in the vertical direction as shown in FIG. 2, but may be installed oppositely in the horizontal direction. In this case, the first and second radio frequency electrodes 32 and 46 have advantages in that they can be the surface or the interior of the barrier rib 50 and that they can lower a height of the barrier rib 50 because electrons do an oscillating motion in the horizontal direction. Also, the first and second radio frequency electrodes 32 and 46 may be installed oppositely in a diagonal direction as shown in FIG. 3. Referring to FIG. 3, the first and second radio frequency electrodes 32 and 46 are installed at the opposed edges of the upper substrate 30 and the lower substrate 40, respectively. If the first and second radio frequency electrodes 32 and 46 are installed oppositely along the diagonal line as described above, then electrons do an oscillating motion on the diagonal line along an arrow within the discharge space 54 at the time of radio frequency discharge. As described above, since a discharge distance is lengthened when the first and second radio frequency electrodes 32 and 46 are opposed in the horizontal direction and opposed on the diagonal line, a frequency of the radio frequency signal can be lowered to that extent.

Figure 4A:
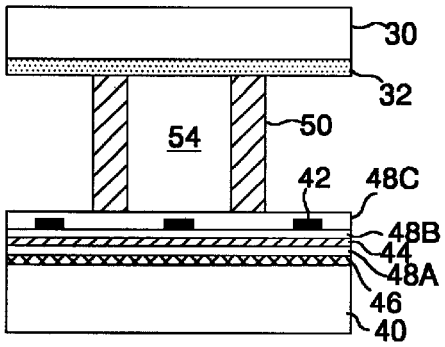
FIGS. 4A to 4D are sectional views for representing a discharge mechanism of the PDP cell shown in FIG. 2 step by step.
Figure 4B:
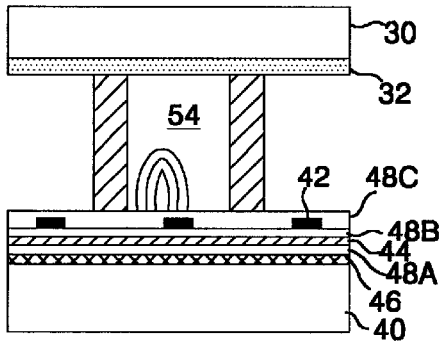
Figure 4C:
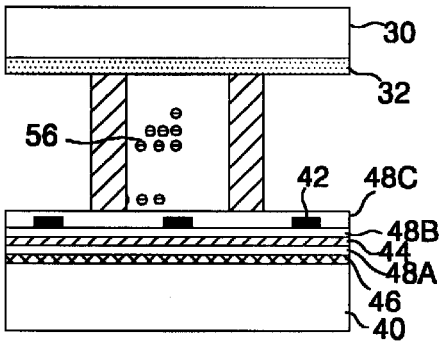
Figure 4D:
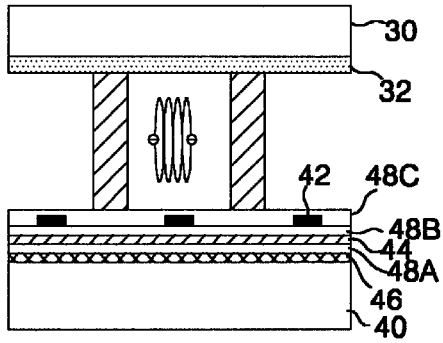

FIGS. 4A to 4D represents a discharge mechanism of the discharge cell shown in FIG. 2. Referring to FIGS. 4A and 4B, an address discharge is caused by a voltage difference between a video data and a scanning pulse applied to the address electrode 42 and the scanning electrode 44, respectively. Electric charged particles are produced at the discharge space 54 by the address discharge. Most of the charged particles produced at the discharge space are accumulated on the third dielectric layer 48C to become a wall charge. If a wall charge accumulated on the surface of the third dielectric layer 48C is formed, then a discharge is interrupted because an electric field within the discharge space 54 by the wall charge. If a radio frequency signal is applied to the first and second radio frequency electrodes 32 and 46 in the discharge cell accumulated with a wall charge, electrons very lighter than a proton are derived onto a space. Herein, an amplitude of the radio frequency signal can be lowered by the accumulated wall charge, and such a radio frequency signal is added to an electric field within the discharge space 54 caused by the wall charge to be applied to the discharge 54 above a discharge initiation voltage. Even when the polarity of such a radio frequency signal is inverted, electrons retrogresses the movement path as shown in FIG. 4D to do an oscillating motion upward and downward, whereas protons keep an almost stationary state because they have a very larger mass than electrons. The electrons doing an oscillating motion ionize and excite a discharge gas continuously, and the excited atom and molecule are transited into a base state to emit a vacuum ultraviolet. The vacuum ultraviolet excites the fluorescent body 52 to allow the fluorescent body 52 to generate a visible light.

A relationship of a frequency f of the radio frequency to a distance r between the first and second radio frequency electrodes 32 and 46 for causing the radio frequency discharge is given by the following formula:

$$r = \frac{eE}{mw\sqrt{w^2 + v_m^2}} \tag{1}$$

wherein r represents a distance between the first and second radio frequency electrodes 32 and 46, m does a mass of electron, $\omega(=2\pi f)$ does a frequency, and $V_m$ does a collision frequency.

It can be seen from the formula (1) that a distance r between the first and second radio frequency electrodes 32 and 46 is inversively proportional to a frequency f of the radio frequency signal. As described above, the frequency f of the radio frequency signal and the distance r between the first and second radio frequency electrodes 32 and 46 is determined. Also, a height of the barrier rib 50 is determined depending on the distance r between the first and second radio frequency electrodes 32 and 46.

Meanwhile, a triggering signal besides a radio frequency signal is applied to the opposed electrodes prior to the radio frequency discharge interval, thereby deriving electrons into the discharge space 54 and producing more electrons as shown in FIG. 4C. An amplitude of the radio frequency signal can be more lowered by the triggering signal, and the radio frequency discharge is stabilized to improve the discharge efficiency as well as the luminescence efficiency. For instance, a negative polarity of triggering signal can be applied to the address electrode 42 and the scanning electrode 44.

Figure 5:
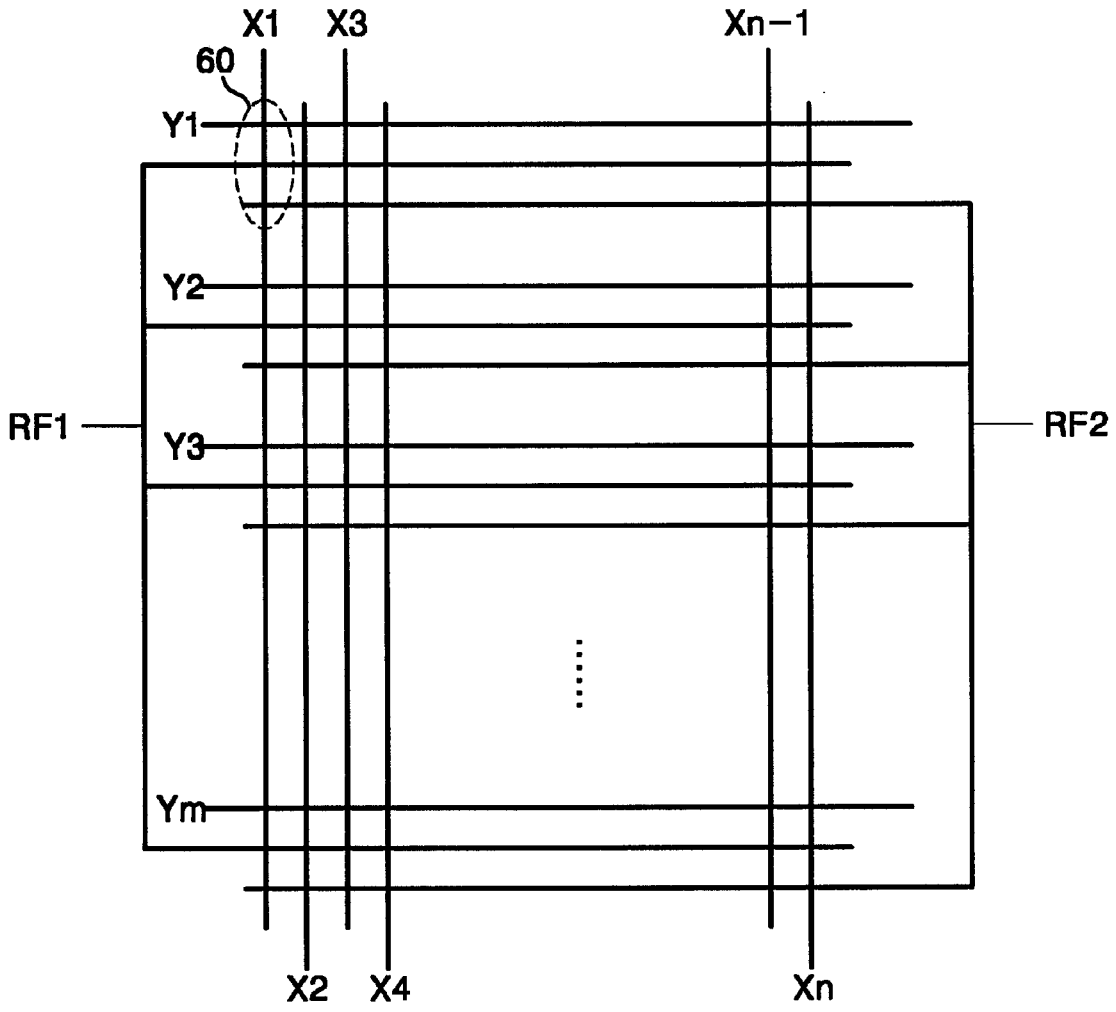
FIG. 5 is a plan view showing an electrode arrangement of the discharge cell in FIG. 2.
Figure 6:
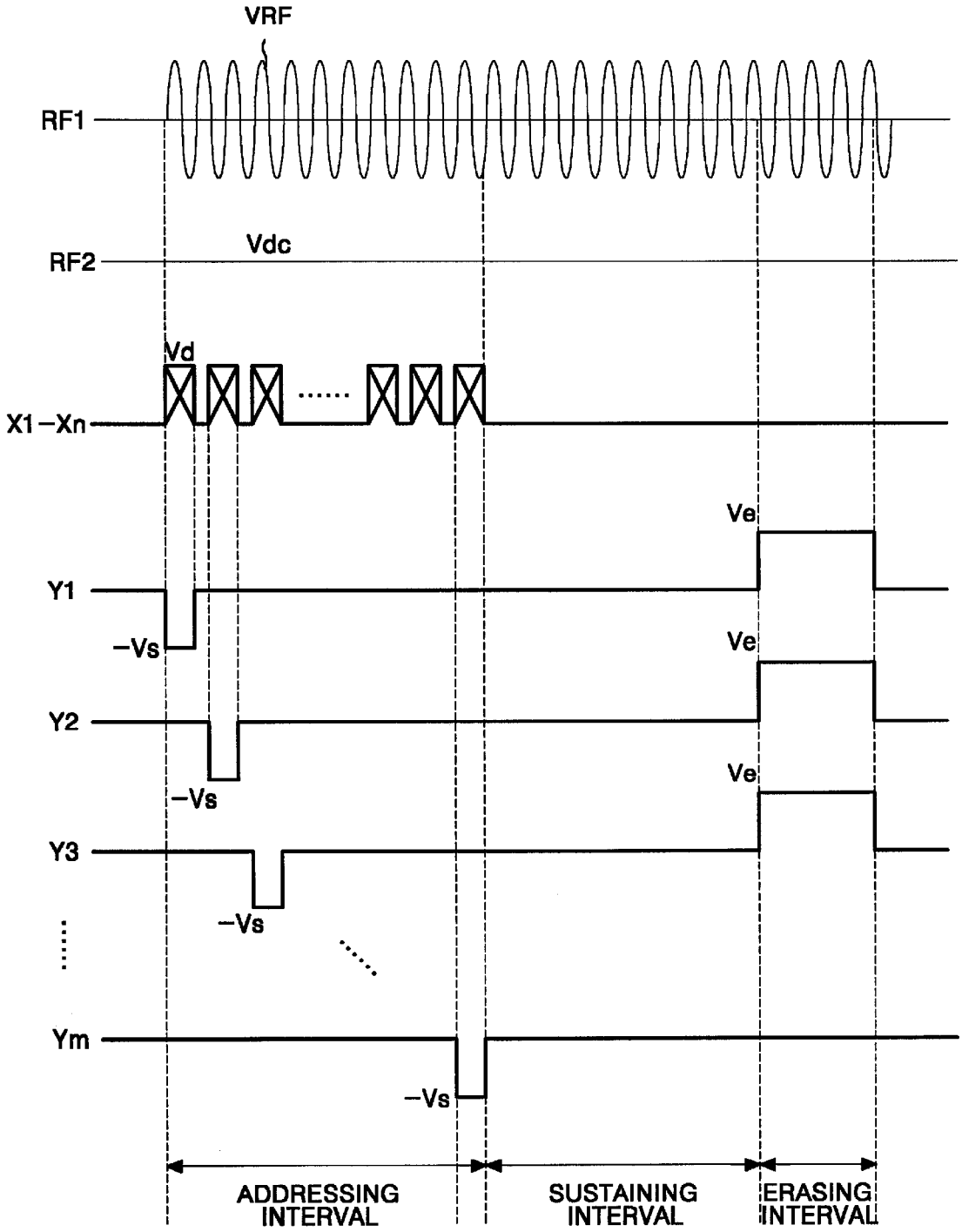
FIG. 6 is waveform diagrams of driving voltages according to an embodiment of the present invention for driving the discharge cell of the radio frequency PDP shown in FIG. 2.

FIG. 5 shows a discharge cell 60 formed at intersections among m scanning electrode lines Y1 to Ym, n address electrode lines X1 to Xn, and first and second radio frequency electrode lines RF1 and RF2. FIG. 6 shows waveforms of driving voltages of the radio frequency PDP in FIG. 2.

Referring to FIG. 5 and FIG. 6, a desired frequency of radio frequency signal VRF is applied to the first radio frequency electrode line RF1, and a direct current bias voltage of the radio frequency signal VRF, that is, a direct current voltage Vdc for providing a reference voltage is applied to the second radio frequency electrode line RF2. The radio frequency signal VRF and the direct current bias voltage Vdc are sustained from an addressing interval until an erasing interval. During the addressing interval, a negative polarity of scanning pulse −Vs is sequentially applied to the scanning electrode lines Y1 to Ym, and a video data Vd is synchronized with a scanning pulse −Vs to be applied to the address electrode lines X1 to Xn. By a voltage difference between the scanning pulse −Vs and the video data Vd, an address discharge is generated between the scanning electrode liens Y1 to Ym applied with the scanning pulse −Vs and the address electrode lines X1 to Xn. In a sustaining interval following the addressing interval, Electrons in the charged particles and the wall charge produced within the discharge space 54 by the address discharge do an oscillating motion within the discharge space 54 in accordance with the radio frequency signal VRF. The electrons doing an oscillating motion ionize and excite a discharge gas to generate a vacuum ultraviolet, which radiates the fluorescent body 52. Accordingly, red, green, and blue visible lights are generated depending on the fluorescent body 52 in the sustaining interval. Herein, the radio frequency signal VRF can cause a radio frequency discharge even when an amplitude, that is, a peak value is lowered to that extent by an electric field within the discharge space caused by the charged particles and the wall charge generated in the addressing interval. In an erasing interval following the sustaining interval, a positive polarity of erasing pulse Ve is simultaneously applied to all the scanning electrode lines Y1 to Ym. Since a tension exerts on the electrons within the discharge space 54 toward the scanning electrode lines Y1 to Ym by the erasing pulse Ve, electrons are restrained into the bottom side of the discharge space 54. Accordingly, the radio frequency discharge and the luminescence are interrupted by the erasing pulse Ve. An application time of the erasing pulse Ve is determined depending on a brightness value, that is, a gray scale value of the video data.

Figure 7:
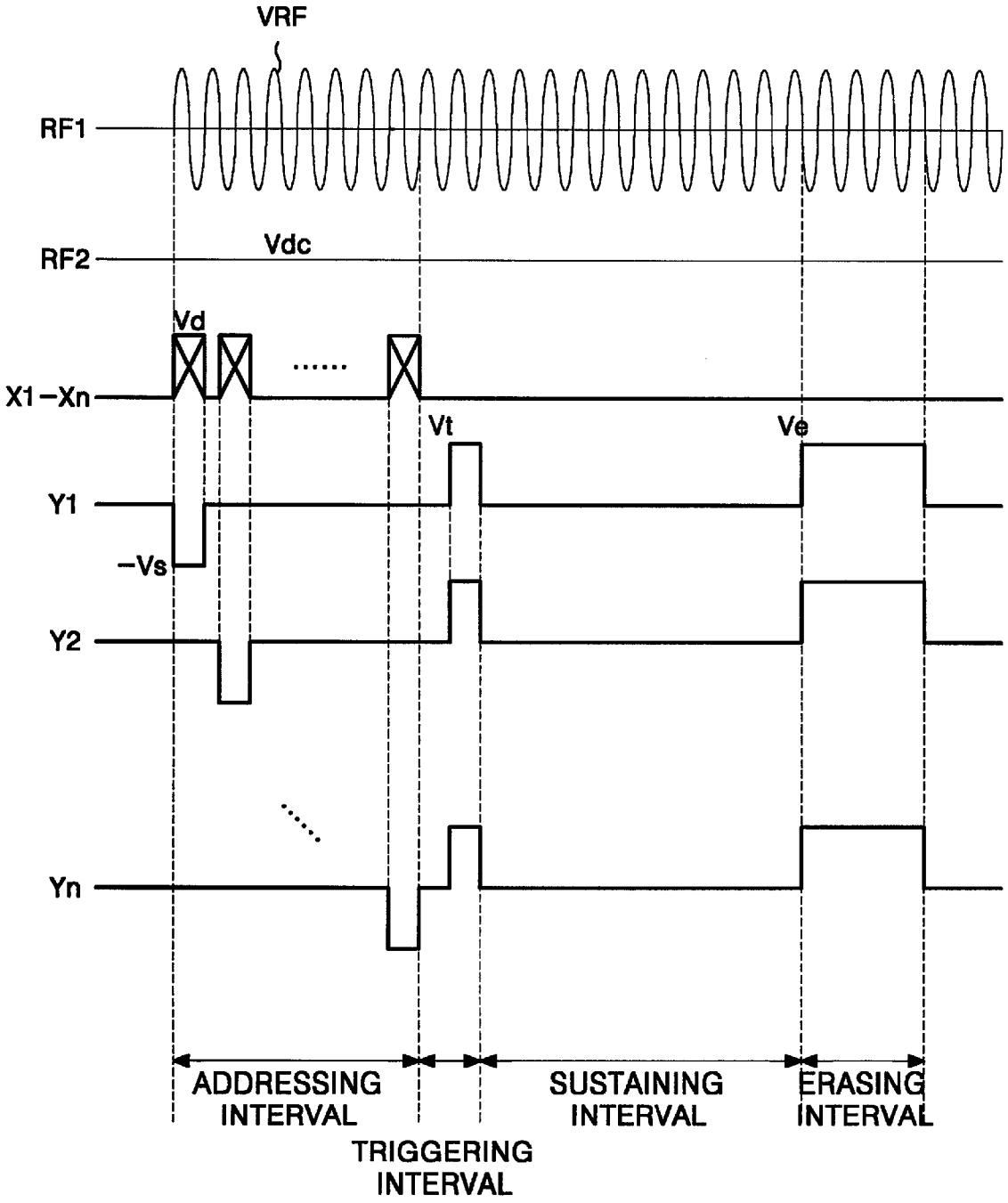
FIG. 7 is waveform diagrams of driving voltages according to another embodiment of the present invention for driving the discharge cell of the radio frequency PDP shown in FIG. 2.

A triggering interval for activating electrons within the discharge space may be included between the addressing interval and the sustaining interval as shown in FIG. 7. In FIG. 7, a positive polarity of triggering pulse Vt is simultaneously applied to all the scanning electrode lines Y1 to Ym in the triggering interval. A discharge is generated between the first radio frequency electrode line RF1 and the scanning electrode lines Y1 to Ym by a voltage difference between the triggering pulse Vt and the radio frequency signal VRF. By this discharge, wall charges are derived into the discharge space 54 and more electrons are produced within the discharge space 54.

Figure 8:
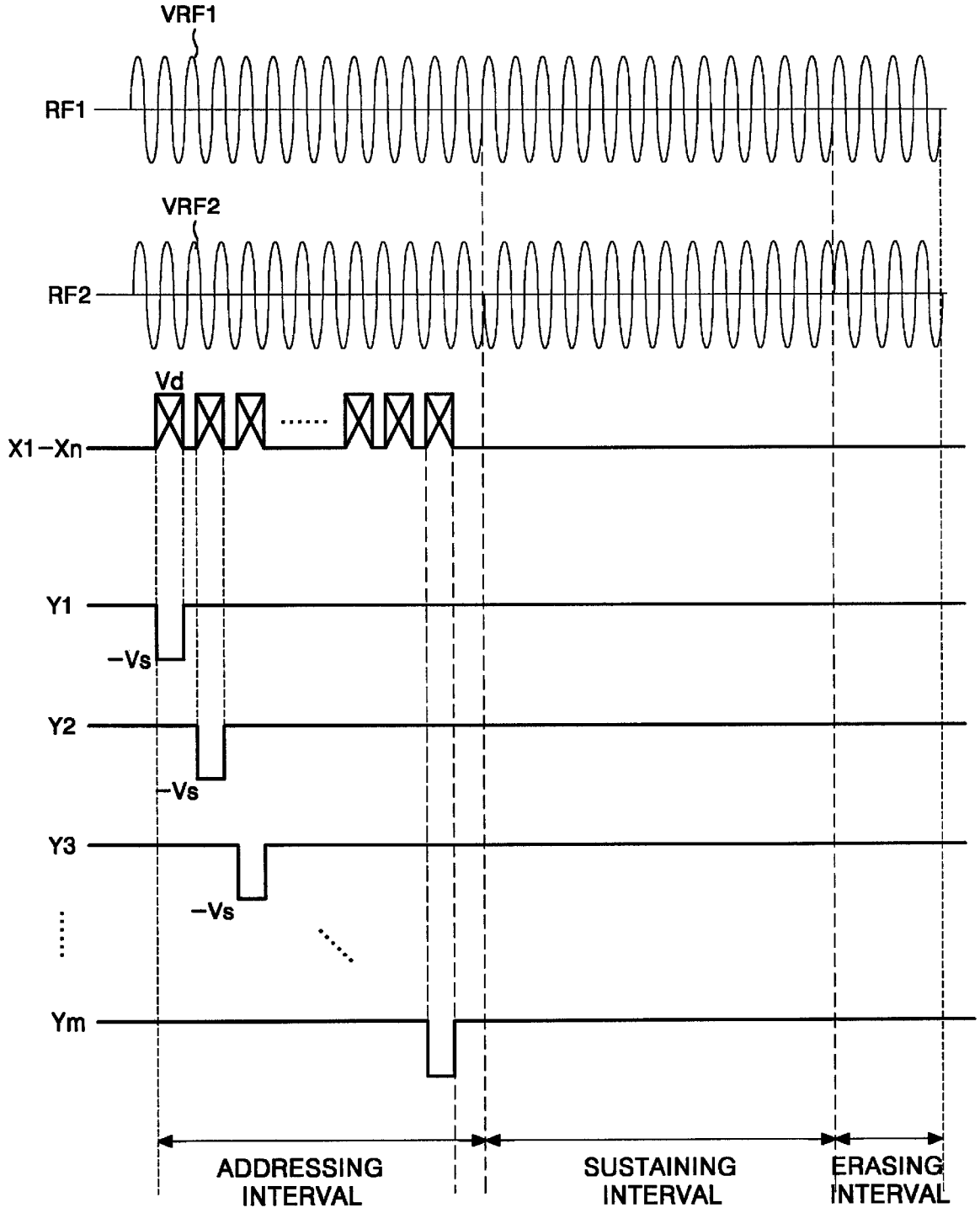
FIG. 8 is waveform diagrams of driving voltages according to still another embodiment of the present invention for driving the discharge cell of the radio frequency PDP shown in FIG. 2.

FIG. 8 shows driving waveforms for the radio frequency PDP according to another embodiment of the present invention. Referring to FIG. 5 and FIG. 8, a desired frequency of first radio frequency signal VRF1 is applied to a first radio frequency electrode line RF1 from an addressing interval until an erasing interval. A second radio frequency signal VRF2 having an inverse phase with respect to the first radio frequency signal VRF1 is applied to a second radio frequency electrode line RF2 in an sustaining interval. The second radio frequency signal VRF2 has the same frequency and amplitude as the first radio frequency signal VRF1, and applied to the second radio frequency electrode lines RF1 and RF2 in a phase identical to the first radio frequency signal VRF1 in an interval except for the sustaining interval. During the addressing interval, the first and second radio frequency signals VRF1 and VRF2 having the same phase are applied to the first and second radio frequency electrode lines RF1 and RF2, respectively. Accordingly, since a voltage difference that can cause a discharge does not emerges between the first and second radio frequency signals RF1 and RF2, a discharge is not generated. In this interval, a video data is applied to the address electrode lines X1 to Xn, and a negative polarity of scanning pulse −Vs synchronized with the video data Vd is sequentially applied to the scanning electrode lines Y1 to Ym. Thus, an address discharge is generated between the scanning electrode lines Y1 to Ym applied with the scanning pulse −Vs and the address electrode lines X1 to Xn. In a sustaining interval following the addressing interval, a phase of the second radio frequency signal VRF2 is inverted. Since the first and second radio frequency signals VRF1 and VRF2 has an inverse phase with respect to each other, they becomes above a voltage difference causing a discharge. Thus, the first and second radio frequency electrode lines RF1 and RF2 cause a sustaining discharge in the sustaining interval. At this time, electrons within the discharge space do an oscillating motion by the sustaining discharge. In the erasing interval, the second radio frequency signal VRF2 is again phase-inverted to have the same phase as the first radio frequency signal VRF1. At this time, since more electric fields are not applied to electrons within the discharge space 54, electrons doing an oscillating motion keep an inertia to be collided with the upper substrate 30 or the lower substrate 40. Accordingly, the sustaining discharge is erased by the first and second radio frequency signals VRFl and VRF2, and a brightness value of a picture is determined depending on an initiation time of the erasing interval, that is, a phase-inverted time of the second radio frequency signal VRF2. A priming pulse or a reset pulse can be applied to the address electrode lines X1 to Xn and the scanning electrode lines Y1 to Ym prior to the addressing interval, and a triggering pulse can be applied prior to the sustaining interval.

Figure 9:
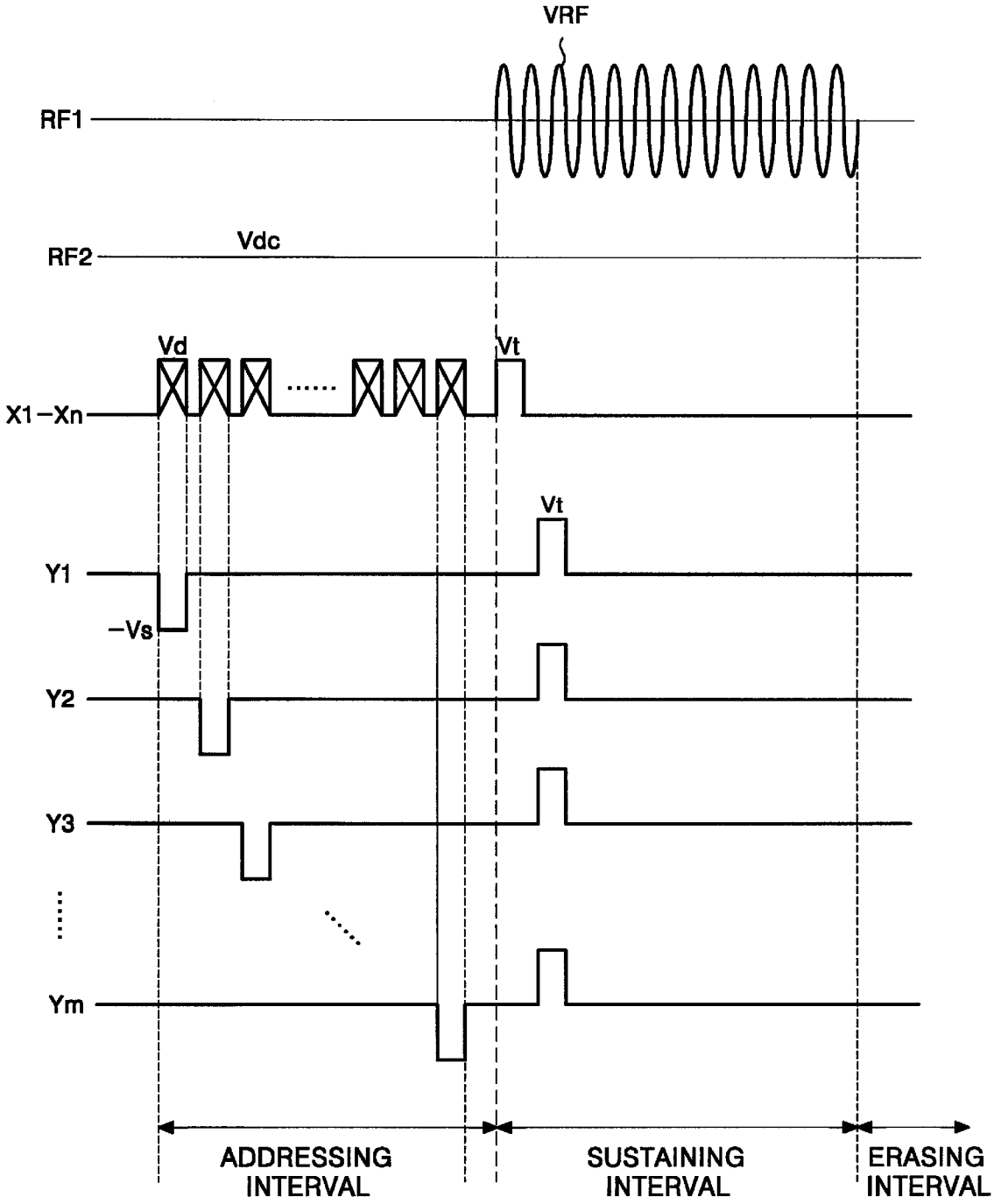
FIG. 9 is waveform diagrams of driving voltages according to a fourth embodiment of the present invention for driving the discharge cell of the radio frequency PDP shown in FIG. 2.

FIG. 9 shows driving waveforms of a radio frequency PDP according to another embodiment of the present invention. Referring to FIG. 9, a desired frequency of radio frequency signal VRF is applied to the first radio frequency electrode line RF1, and a direct bias voltage Vdc of the radio frequency signal VRF is applied to the second radio frequency line RF2. The radio frequency signal VRF is turned off in an interval except for the radio frequency electrode to be converted into a direct current voltage. In other words, the radio frequency signal VRF is switched in accordance with the radio frequency discharge. During the address interval, a negative polarity of the scanning pulse −Vs is sequentially applied to the radio frequency signal VRF, and a video data Vd is applied to the address electrode lines X1 to Xn with being synchronized with a scanning pulse −Vs. By a voltage difference between the scanning pulse −Vs and the video data Vd, an address interval is caused between the scanning electrode lines Y1 to Ym applied with the scanning pulse −Vs and the address electrode lines X1 to Xn. In a sustaining interval following the address interval, a positive polarity of triggering pulse Vt is applied to the scanning electrode lines Y1 to Ym and the address electrode lines X1 to Xn. Electrons produced in the addressing interval by the triggering pulse Vt are derived into the discharge space 54, and more electrons are generated within the discharge space 54. Also, since the radio frequency signal VRF is applied to the first radio frequency electrode line RF1 in the sustaining interval, electrons within the discharge space 54 do an oscillating motion by the radio frequency signal VRF. In the erasing interval, a radio frequency signal VRF is turned off to be converted into a ground level of direct current voltage. Accordingly, since electrons do not any longer move, a luminescence is interrupted. A brightness value of a picture is determined depending on an off time of the radio frequency signal VRF1.

Figure 10:
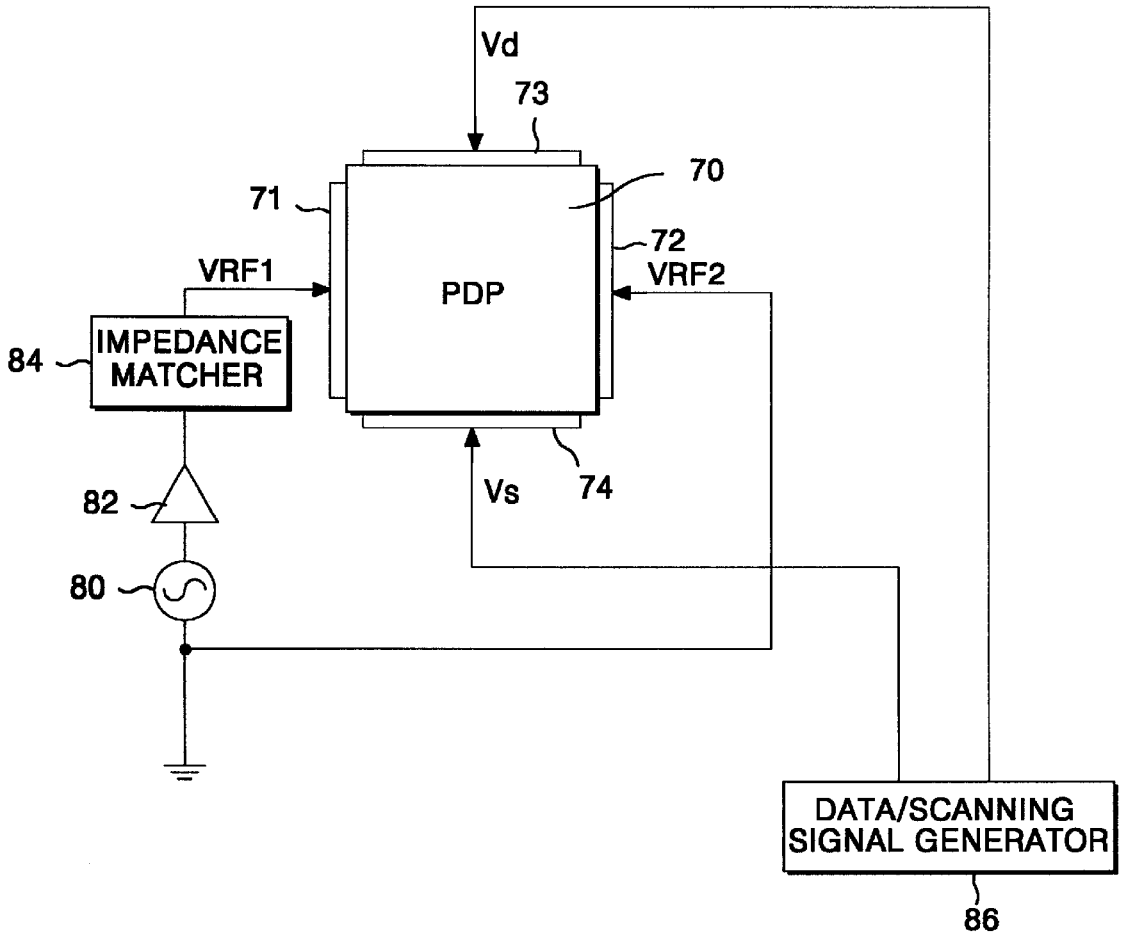
FIG. 10 is a block diagram showing the configuration of a driving apparatus for the radio frequency PDP according to an embodiment of the present invention.

Referring now to FIG. 10, there is shown a driving apparatus for a radio frequency PDP according to an embodiment of the present invention. The driving apparatus includes a radio frequency signal source 80 for generating a radio frequency signal VRF, a data/scanning signal generator 86 for generating a video data Vd and a scanning pulse Vs, and an impedance matcher 84 and an amplifier 82 connected, in series, between a first radio frequency input terminal 71 in a PDP 70 and the radio frequency signal source 80. The amplifier 82 amplifies the radio frequency signal VRF from the radio frequency signal source 80 by its gain value and applies the same to the impedance matcher 84. The impedance matcher 84 matches an impedance value at the radio frequency signal source 80 and the amplifier 82 with an impedance value at the PDP 70. By such an impedance matching, a maximum power of the radio frequency signal VRF is applied to the PDP 70. A ground voltage GND of the radio frequency signal VRF is applied to the radio frequency input terminal 72. The data/scanning signal generator 86 is connected to a data input terminal 73 and a scanning pulse input terminal 74 in the PDP 70 to apply the video data Vd and the scanning pulse Vs to the data input terminal 73 and the scanning pulse input terminal 74, respectively. Also, the data/scanning signal generator 86 applies a priming pulse, a reset pulse and a triggering pulse to each of the data input terminal 73 and the scanning pulse input terminal 74.

Figure 11:
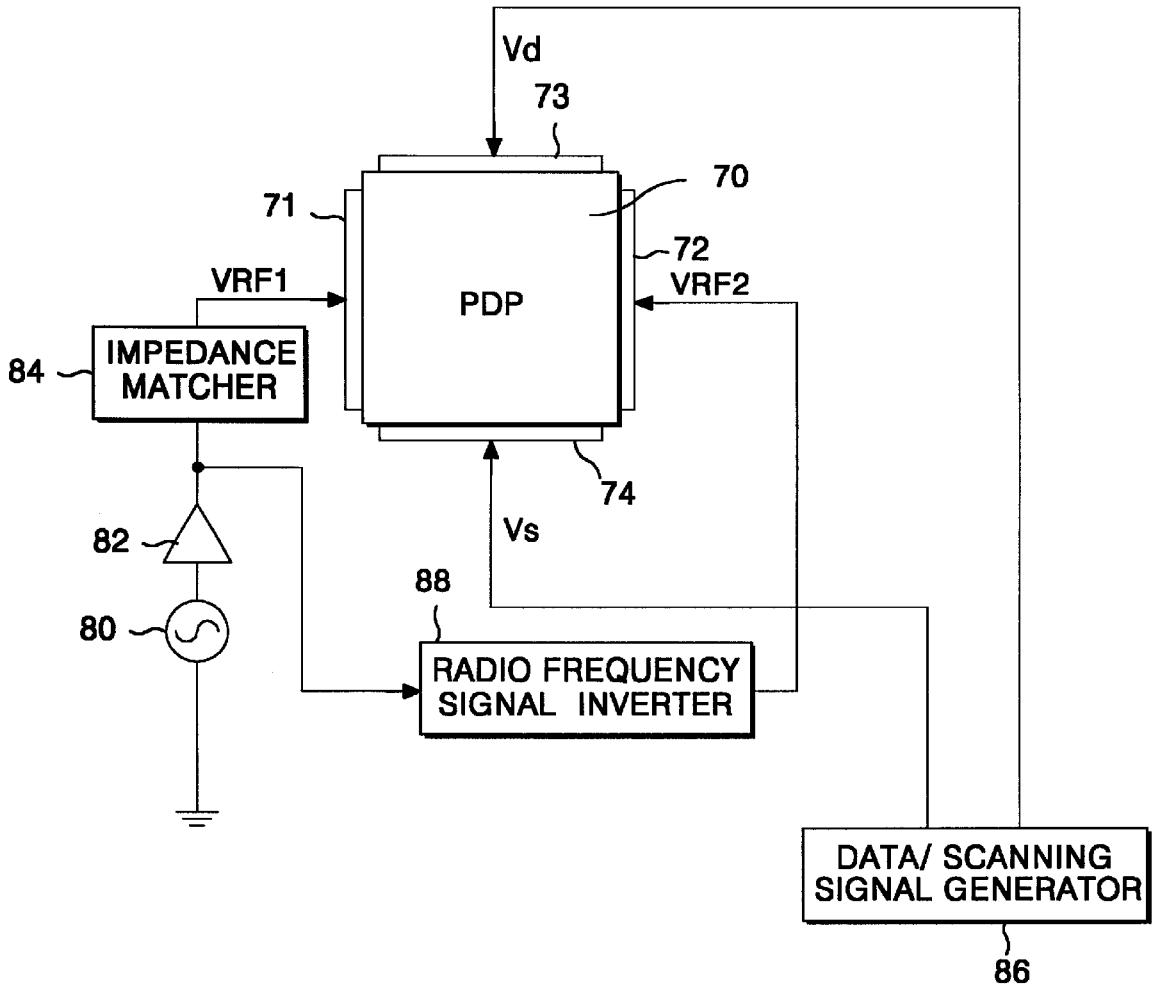
FIG. 11 is a block diagram showing the configuration of a driving apparatus for the radio frequency PDP according to another embodiment of the present invention.

As shown in FIG. 11, a second radio frequency signal VRF2 may be applied to the second radio frequency input terminal 72 in the PDP 70 by a radio frequency signal inverter 88. The radio frequency signal inverter 88 is connected between an output terminal of the radio frequency signal source 80 and the second radio frequency input terminal 72 to apply a radio frequency signal from the radio frequency signal source 80 to the second radio frequency input terminal 72 in a time interval except for the sustaining interval, whereas it phase-inverts a radio frequency signal from the radio frequency signal source 80 in the sustaining interval and applies the same to the second radio frequency input terminal 72.

As described above, in the radio frequency PDP according to the present invention, an address electrode for an address discharge and a data electrode are installed adjacently and the first and second radio frequency electrodes for a radio frequency discharge are installed in parallel. A distance between the first and second radio frequency electrodes is sufficiently assured such that an oscillating motion of electrons does not undergo an interference. Accordingly, the radio frequency PDP according to the present invention has a structure suitable for an alternating current discharge used for the address discharge as well as for a radio frequency discharge used for the sustaining discharge. The driving method and apparatus for the radio frequency PDP according to the present invention causes an address discharge by a pulse signal having a control easiness and causes a radio frequency discharge by a radio frequency signal and a triggering pulse for activating the radio frequency discharge or causes a radio frequency discharge by switching the radio frequency signal, so that it is suitable for driving the radio frequency PDP. Moreover, the driving method and apparatus for the radio frequency PDP according to the present invention matches an impedance of the PDP with that of the radio frequency signal source such that a maximum power of the radio frequency signal can be applied to the PDP.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A radio frequency plasma display panel having a discharge space provided between an upper substrate and a lower substrate, comprising:

a data electrode to which a data is applied;

a scanning electrode for causing an address discharge along with the data electrode by applying a scanning pulse, said scanning electrode being arranged perpendicularly to the data electrode;

a radio frequency electrode to which a radio frequency signal is applied; and a radio frequency reference electrode for causing a radio frequency discharge along with the radio frequency electrode by applying a reference voltage of the radio frequency signal.

2. The plasma display panel as claimed in claim 1, wherein said radio frequency electrode is formed on the upper substrate, and said radio frequency reference electrode is formed on the lower substrate in parallel to the radio frequency electrode.

3. The plasma display panel as claimed in claim 2, further comprising:

a fluorescent layer formed on a barrier rib and the upper substrate.

4. The plasma display panel as claimed in claim 2, wherein said radio frequency electrode is formed on the upper substrate in parallel to the radio frequency reference electrode, and said data electrode is formed on the lower substrate in a direction perpendicular to the scanning electrode.

5. The plasma display panel as claimed in claim 4, further comprising:

a first dielectric layer formed between the radio frequency reference electrode and the scanning electrode to electrically insulate between the radio frequency reference electrode and the scanning electrode;

a second dielectric layer formed between the scanning electrode and the data electrode to electrically insulate between the scanning electrode and the data electrode; and a third dielectric layer formed on the data electrode and the second dielectric layer.

6. The plasma display panel as claimed in claim 2, wherein said radio frequency electrode and the radio frequency reference electrode are formed on the upper substrate and the lower substrate, respectively, in such a manner to be opposed in a diagonal direction.

7. The plasma display panel as claimed in claim 1, wherein the reference voltage of said radio frequency signal is any one of a ground voltage and a desired level of direct current voltage.

8. The plasma display panel as claimed in claim 1, wherein the reference voltage of said radio frequency signal is a radio frequency signal phase-inverted with respect to the radio frequency signal.

9. A driving method for a radio frequency plasma display panel, comprising the steps of:

applying a voltage to each of a data electrode and a scanning electrode included in the display panel; and applying a radio frequency signal and a reference voltage of the radio frequency signal to the radio frequency electrode and the radio frequency reference electrode included in the display panel, respectively, in such a manner that electrons within the discharge cell do an oscillating motion, thereby causing a radio frequency discharge.

10. The driving method as claimed in claim 9, further comprising the step of:

applying a triggering pulse to the scanning electrode and the data electrode in such a manner that the electrons within the discharge cell are activated.

11. The driving method as claimed in claim 9, further comprising the step of:

applying an erasing pulse to the scanning electrode in such a manner that the radio frequency discharge is interrupted.

12. The driving method as claimed in claim 11, wherein an application time of the erasing pulse is determined depending on a brightness value of the data.

13. The driving method as claimed in claim 9, further comprising:

switching the radio frequency signal in such a manner that a radio frequency voltage is applied only in a time interval when the radio frequency discharge is sustained, thereby interrupting the radio frequency discharge.

14. A driving method for a radio frequency plasma display panel, comprising the steps of:

applying a voltage to each of a data electrode and a scanning electrode included in the display panel to produce electrons within a discharge cell; and applying phase-inverted radio frequency signals to each of the first and second radio frequency electrodes included in the display panel in such a manner that the electrons within the discharge cell do an oscillating motion, thereby causing a radio frequency discharge.

15. The driving method as claimed in claim 14, further comprising the step of:

applying a triggering pulse to the scanning electrode and the data electrode in such a manner that the electrons within the discharge cell are activated.

16. The driving method as claimed in claim 14, wherein a phase of the second radio frequency signal applied to the second radio frequency electrode is identical to that of the first radio frequency signal applied to the first radio frequency electrode in a time interval except for the radio frequency discharge interval.

17. The driving method as claimed in claim 16, further comprising the step of:

converting the phase of the second radio frequency signal into the same phase as the first radio frequency signal in such a manner that the radio frequency discharge is interrupted.

18. The driving method as claimed in claim 17, wherein the phase conversion time of the second radio frequency signal is determined depending on a brightness value of the data.

19. A driving apparatus for a radio frequency plasma display panel, comprising:

said display panel having a data electrode supplied with a data, a scanning electrode for causing an address discharge along with the data electrode, a radio frequency electrode applied with a radio frequency signal, and a radio frequency reference electrode for causing a radio frequency discharge along with the radio frequency electrode;

an address driver for causing an address discharge by applying the data and a scanning pulse to the data electrode and the scanning electrode, respectively; and a radio frequency driver for causing a radio frequency discharge by applying a radio frequency signal and a reference voltage of the radio frequency signal to the radio frequency electrode and the radio frequency reference electrode, respectively.

20. The driving apparatus as claimed in claim 19, wherein said address driver applies a triggering pulse to the scanning electrode and the data electrode after the address discharge in such a manner that electrons within the discharge cell are activated.

21. The driving apparatus as claimed in claim 19, wherein said radio frequency driver switches the radio frequency signal in such a manner that a radio frequency voltage is applied only in a time interval when the radio frequency discharge is sustained.

22. The driving apparatus as claimed in claim 19, further comprising:

an impedance matcher for matching the display panel with an impedance value of the radio frequency driver.

23. The driving apparatus as claimed in claim 19, wherein said radio frequency driver applies any one of a ground voltage and a desired level of direct current voltage as a reference voltage of the radio frequency signal to the radio frequency reference electrode.

24. The driving apparatus as claimed in claim 19, wherein said radio frequency driver applies a radio frequency signal phase-inverted with respect to the radio frequency signal as a reference voltage of the radio frequency signal to the radio frequency reference electrode.

25. The driving apparatus as claimed in claim 19, wherein said radio frequency driver synchronizes phases of radio frequency signals applied to the radio frequency electrode and the radio frequency reference electrode in a time interval when the radio frequency discharge is sustained.

* * * * *